US006463610B1

(12) United States Patent
Shulte et al.

(10) Patent No.: US 6,463,610 B1
(45) Date of Patent: Oct. 15, 2002

(54) MULTI-CHAMBER AIRBED

(75) Inventors: Robert Shulte, Agusta, KS (US); Douglas R. Casto, Wichita, KS (US); J. Patrick Barnett, Derby, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/627,527

(22) Filed: Jul. 28, 2000

(51) Int. Cl.[7] ..... A47C 27/10
(52) U.S. Cl. ..... 5/712; 5/710; 5/706
(58) Field of Search ..... 5/712, 706, 710, 5/713, 716, 720, 727, 654, 655.3, 655.8, 655.7

(56) References Cited

U.S. PATENT DOCUMENTS

| | | | | | |
|---|---|---|---|---|---|
| 2,059,226 | A | * | 11/1936 | Gates | 5/706 X |
| 2,629,111 | A | * | 2/1953 | Korney | 5/716 |
| 2,651,788 | A | * | 9/1953 | Forwood | 5/727 X |
| 2,814,053 | A | * | 11/1957 | Sevcik | 5/710 |
| 3,918,110 | A | * | 11/1975 | Cantillo et al. | 5/687 |
| 4,459,714 | A | * | 7/1984 | Lin | 5/655.3 |
| 4,737,999 | A | * | 4/1988 | Halverson | 5/710 |
| 4,819,287 | A | * | 4/1989 | Halverson | 5/710 |
| 5,027,454 | A | * | 7/1991 | Peng | 5/706 X |
| 5,237,712 | A | * | 8/1993 | Ramsay | 5/710 |
| 5,329,656 | A | * | 7/1994 | Leggett | 5/712 X |
| 5,425,147 | A | * | 6/1995 | Supplee et al. | 5/713 |
| 5,452,487 | A | * | 9/1995 | Leggett | 5/712 X |
| 5,608,931 | A | * | 3/1997 | Gancy | 5/712 |
| 5,852,839 | A | * | 12/1998 | Gancy | 5/706 |
| 5,918,336 | A | * | 7/1999 | Lee et al. | 5/706 X |

FOREIGN PATENT DOCUMENTS

| | | | | |
|---|---|---|---|---|
| EP | 316265 A | * | 5/1989 | 5/654 |
| FR | 2406411 A1 | * | 5/1979 | 5/716 |
| RU | 583024 A | * | 2/1977 | 5/654 |

* cited by examiner

*Primary Examiner*—Robert G. Santos
(74) *Attorney, Agent, or Firm*—Leydig, Voit & Mayer, Ltd.

(57) ABSTRACT

A multi-chamber airbed reduces the effect of weight movement by one or more persons sleeping or sitting on the airbed. In the multi-chambered airbed of the present invention, there are at least two chambers inside the airbed, each chamber having its own air valve and representing its own portion of the airbed. The chambers are completely sealed off from each other by a barrier or septum within the airbed. Thus, when one person shifts his or her weight on the portion of the airbed over one chamber, air does not flow to the other chamber or portion of the airbed.

8 Claims, 3 Drawing Sheets

MULTI-CHAMBER AIRBED

FIELD OF THE INVENTION

The present invention relates to inflatable airbeds; specifically to a multi-chamber airbed.

BACKGROUND OF THE INVENTION

Inflatable airbeds (i.e., "airbeds") are well known in the art and have proven themselves to be very useful. On the one hand, when there is no need to sleep on the inflatable airbed, the owner may simply deflate the airbed (i.e., let all the air out), fold it up, and then store it away in a closet or basement. On the other hand, when guests arrive or when the owner of the airbed takes a trip to a place where there is no bed to sleep on, the owner may simply inflate the airbed and sleep on it.

Current inflatable airbeds have a single chamber, meaning that air can travel anywhere inside the airbed since there is no barrier sealing off one portion of the airbed from another. Therefore, when multiple people sleep or sit on the airbed, air is constantly being moved from one portion of the airbed to another as the weight of the person is shifted.

For example, suppose person A is sleeping on the left side of an inflated queen size airbed. Because there is currently no weight on the right side of the airbed, air would naturally flow toward the unweighted right side of the airbed until an equilibrium pressure condition is established (i.e., the right side cannot hold anymore air). This shifting of air to the right side consequently would cause the right side of the airbed to rise. However, coils within the airbed prevent the right side from rising beyond a certain height.

Next, suppose person B wants to sleep on the now elevated right side of the airbed. As person B descends onto the right side of the airbed, this new weight causes a redistribution of the air back toward the left side of the airbed where person A is sleeping. Air flows back to the left side of the air bed, causing the left side to rise due to the newly added air pressure underneath. This unexpected elevation in the left side of the airbed may even awake person A. Furthermore, each time person A or B moves around during their sleep and causes a shift in weight on the airbed, air will also be shifted arounded inside the entire airbed. This constant movement of air inside the entire airbed in response to weight shifts causes different portions of the airbed to rise and fall until the weight movement stops. This constant rocking, elevation or depression of various portions of the airbed every time one person moves can disrupt a good night's sleep.

SUMMARY OF THE INVENTION

In an exemplary embodiment, the present invention reduces the effect of weight movement by one or more persons sleeping or sitting on the airbed by providing for a multi-chamber airbed. In the multi-chamber airbed of the present invention, there are at least two chambers inside the airbed, each chamber having its own air valve and representing its own portion of the airbed. The chambers are completely sealed off from each other by a barrier or septum within the airbed. Thus, when one person shifts his or her weight on the portion of the airbed over one chamber, air does not flow into the other chamber or portion of the airbed.

DETAILED DESCRIPTION OF THE INVENTION

In the following description, various aspects of the present invention will be described. For purposes of explanation, specific configurations and details are set forth in order to provide a thorough understanding of the present invention. Furthermore, well known features may be omitted or simplified in order not to obscure the present invention.

In the exemplary embodiment, there is provided a multi-chamber airbed. In the exemplary embodiment shown, the multi-chamber airbed will be described as a dual chamber airbed (i.e., an airbed with two chambers). One skilled in the art will recognize that the airbed of the present invention can have more chambers if so desired.

Figure 1:
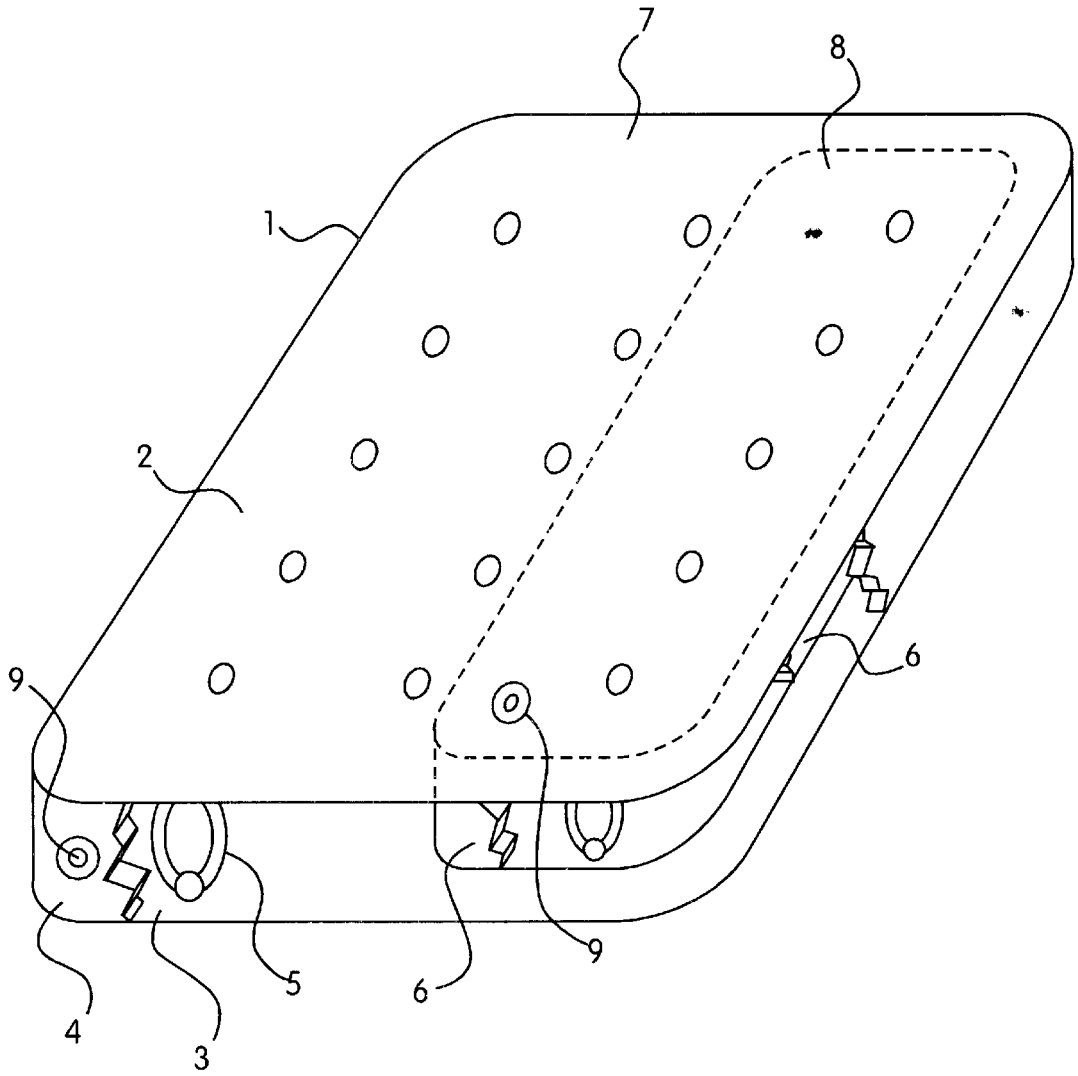
FIG. 1 is a perspective cut away view of an embodiment of a multi-chamber airbed in accordance with the present invention.
Figure 2:
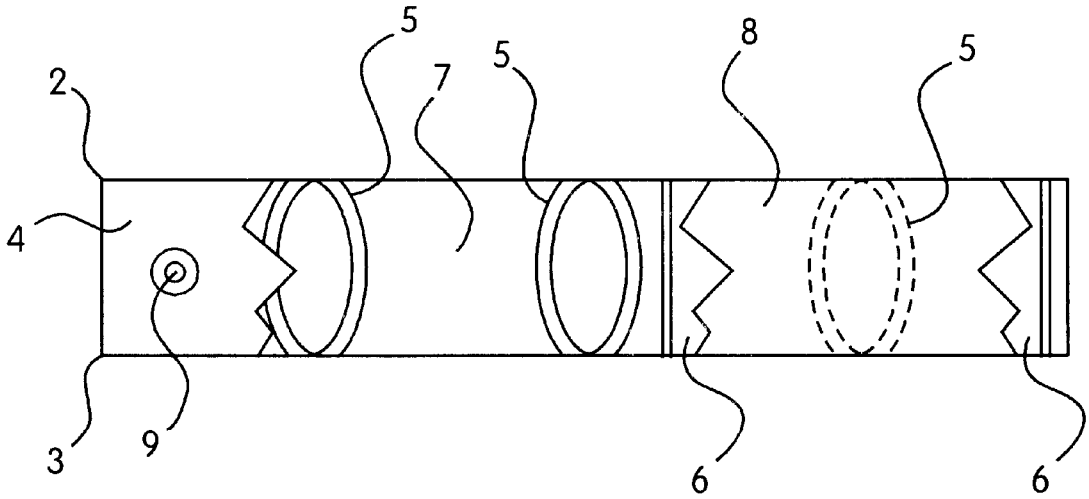
FIG. 2 is a front cut away view an embodiment of a multi-chamber airbed in accordance with the present invention.

As shown in FIGS. 1 and 2, in the exemplary embodiment, the exterior of the multi-chamber airbed 1 of the present invention may be of any design known in the art. The airbed 1 of the exemplary embodiment shown includes a top sheet 2, a bottom sheet 3, and a side trim 4 wherein the top edges of the side trim 4 are connected to the edges of top sheet 2 and the bottom edges of the side trim 4 are connected to the edges of bottom sheet 3 such that the airbed 1 forms a sealed vessel or container to keep the air or any other gaseous medium inside the airbed 1. The side trim 4 may be connected to the top sheet 2 and bottom sheet 3 by any welding or sealing means known in the art to prevent gas from leaking out at the connection seams. Alternatively, the top sheet 2, bottom sheet 3, and side trim 4 can all be made of one piece so that no welding or sealing is necessary.

As shown in FIGS. 1 and 2, there are also coils 5 located throughout the interior of the airbed 1 which are connected on one end to the top sheet 2 and on the other end to the bottom sheet 3. These coils 5 serve to maintain the shape of the airbed 1 by preventing the various portions of the top sheet 2 (or bottom sheet 3) from stretching out too far (for example, into a balloon shape) when air is shifted by movement of weight on the airbed 1.

Also shown in FIGS. 1 and 2, in an exemplary embodiment of the present invention, there is a first chamber 7 and a second chamber 8 created by an internal barrier 6 (or septum). As shown in FIG. 1, the internal barrier 6 creates the second chamber 8 by completely sealing off one portion of the airbed 1 from its neighboring or surrounding portion such that no air or gas from the area outside this sealed off portion can flow into it. In the exemplary embodiment shown in FIGS. 1 and 2, this seal is created, for example, by connecting (i.e, sealing or welding) the top edge of the internal barrier 6 to the top sheet 2 and the bottom edge of the internal barrier 6 to the bottom sheet 3.

Figure 3:
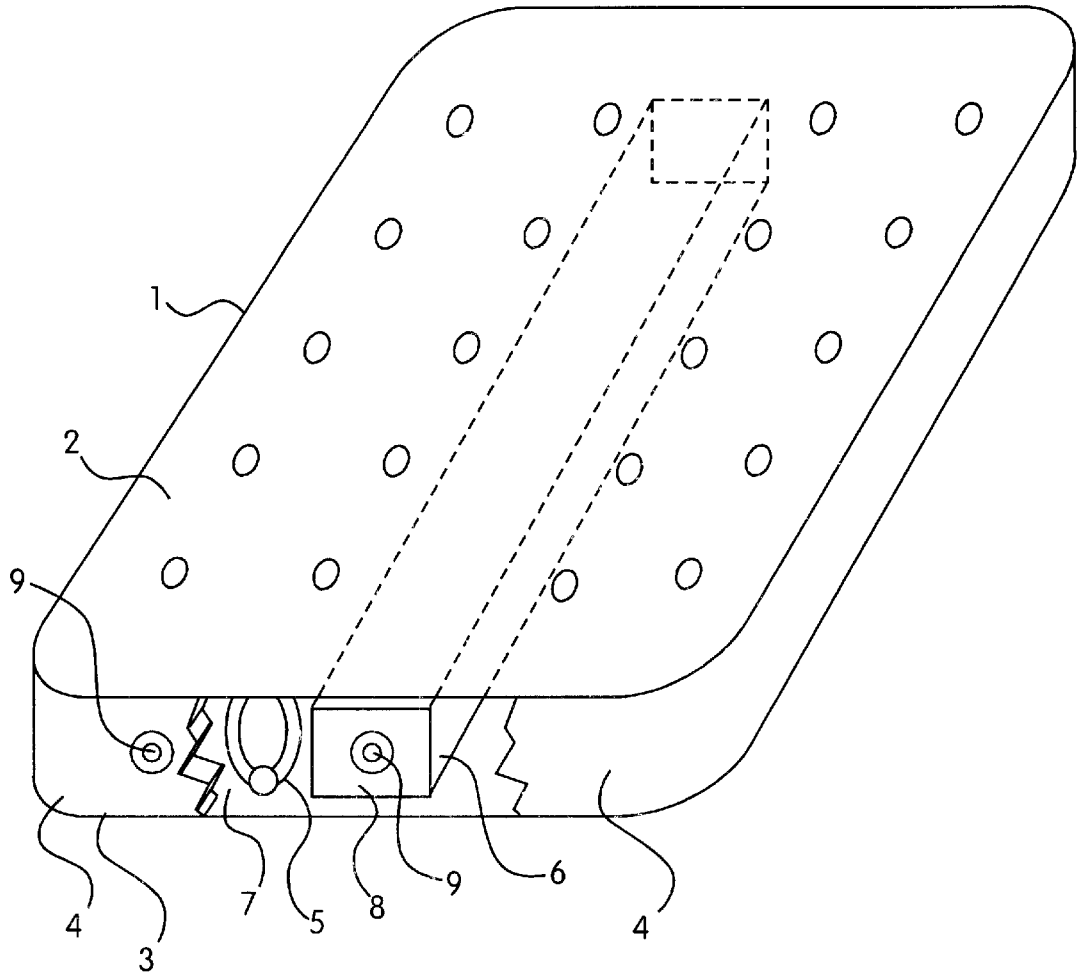
FIG. 3 is a perspective cut away view of an alternative embodiment of a multi-chamber airbed in accordance with the present invention.

Alternatively, in an alternative embodiment shown in FIG. 3, the internal barrier 6 is not connected to either the top sheet 2 or bottom sheet 3 so that the second chamber 8 can move freely within a first chamber 7. Instead, as shown in FIG. 3, the internal barrier 6 is only attached to the side trim 4. In yet another alternative embodiment, the internal barrier 6 may be connected to only one of a top sheet 2 or a bottom sheet 3. In accordance with the present invention, the internal barrier 6 can be arranged or attached in a variety of configurations so long as the internal barrier 6 prevents air from flowing from one chamber to another.

In the exemplary embodiment shown in FIGS. 1 and 2, the second chamber 8 is located within the first chamber 7. Alternatively, the first chamber 7 and second chamber 8 of the exemplary embodiment shown can be two separate chambers instead of one being located within he other. For example, the internal barrier 6 can simply be one strip running down the middle of he airbed 1 to internally separate the right half of the airbed 1 from the left half of the airbed 1.

Furthermore, while it is shown in the exemplary embodiment in FIGS. 1 and 2 that the internal barrier 6 creates a simple rectangular shaped second chamber 8, one skilled in the art will recognize that other shapes of first chamber 7 or second chamber 8 (or other chambers if more than two) are possible. For example, the internal barrier 6 may form chambers the shape of a square, oval, circle, cylinder, or any shapes as desired, including amorphous shapes.

In the exemplary embodiment shown in FIGS. 1 and 2 (and the alternative embodiment shown in FIG. 3), there is also an air valve 9 for each chamber 7 and 8. The air valve 9 may be any air valve known in the art, such as a Double Lock valve, a Boftic valve, etc. As air cannot flow from one chamber to the other, it is necessary that each chamber in the exemplary embodiment shown has its own valve 9 to fill up each chamber individually. Since each chamber has its own air valve 9, the user can fill the first chamber 7 with more air pressure than the second chamber 8, for example, to make one portion of the airbed 1 firmer than the other as desired. Additionally, the user can also choose, for example, to only fill up the first chamber 7 or second chamber 8 instead of inflating the whole airbed 1. In the exemplary embodiment shown, the two air valves 9 may be located anywhere on the top sheet 2, bottom sheet 3, or side trim 4 within their respective chambers.

The airbed 1, coils 5, and internal barrier 6 may be made of any material such as vinyl, plastic, rubber, etc. which are not permeable to air or gas.

What is claimed is:

1. A multi-chamber airbed, comprising:

a top sheet, a bottom sheet, a side trim, the side trim being connected on a top side to the top sheet and on a bottom side to the bottom sheet to form a vessel for containing gas, a plurality of coils, each of the coils having a first end connected to the top sheet and having a second end connected to the bottom sheet, and an internal barrier, the internal barrier creating a first chamber and a second chamber within the airbed such that gas cannot flow between the first and second chambers.

2. The multi-chamber airbed of claim 1, further including a first air valve for the first chamber and a second air valve for the second chamber.

3. The multi-chamber airbed of claim 1, wherein the top sheet, the bottom sheet, the side trim, the plurality of coils, and the internal barrier are made from vinyl.

4. The multi-chamber airbed of claim 1, wherein the second chamber is positioned within the first chamber.

5. A multi-chamber airbed, comprising:

a top sheet, a bottom sheet, a side trim, the side trim being connected on a top side to the top sheet and on a bottom side to the bottom sheet to form a vessel for containing gas, a plurality of coils, each of the coils having a first end connected to the top sheet and having a second end connected to the bottom sheet, and an internal barrier, the internal barrier creating a plurality of separate chambers within the airbed such that gas cannot flow between any of the chambers.

6. The multi-chamber airbed of claim 5, further including a separate air valve for each of the separate chambers.

7. The multi-chamber airbed of claim 5, wherein the top sheet, the bottom sheet, the side trim, the plurality of coils, and the internal barrier are made from vinyl.

8. The multi-chamber airbed of claim 5, wherein the one of the plurality of separate chambers is positioned within another one of the plurality of separate chambers.

* * * * *

UNITED STATES PATENT AND TRADEMARK OFFICE

CERTIFICATE OF CORRECTION

PATENT NO. : 6,463,610 B1 
DATED : October 15, 2000
INVENTOR(S) : Robert Schulte, Douglas R. Casto and J. Patrick Barnett It is certified that error appears in the above-identified patent and that said Letters Patent is hereby corrected as shown below:

Title page,
Item [75], replace "Shulte" with -- Schulte --
Replace "Agusta" with -- Augusta --

Signed and Sealed this

Twenty-fifth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,463,610 B1 
DATED : October 15, 2002
INVENTOR(S) : Robert Schulte, Douglas R. Casto and J. Patrick Barnett It is certified that error appears in the above-identified patent and that said Letters Patent is hereby corrected as shown below:

Column 4,
Line 4, insert -- being made of the same material as one of the top sheet and the bottom sheet and -- after "a plurality of coils, each of the coils"
Line 27, insert -- being made of the same material as one of the top sheet and the bottom sheet and -- after "a plurality of coils, each of the coils"

Signed and Sealed this

Twentieth Day of April, 2004

JON W. DUDAS
*Acting Director of the United States Patent and Trademark Office*